US011352677B2

(12) United States Patent
Onodera et al.

(10) Patent No.: US 11,352,677 B2
(45) Date of Patent: Jun. 7, 2022

(54) METHOD OF PRODUCING SOFT MAGNETIC MATERIAL

(71) Applicant: TOYOTA JIDOSHA KABUSHIKI KAISHA, Toyota (JP)

(72) Inventors: Kiyotaka Onodera, Nisshin (JP); Kiyonori Suzuki, Clayton (AU); Richard Parsons, Clayton (AU); Bowen Zang, Clayton (AU)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 202 days.

(21) Appl. No.: 16/323,228

(22) PCT Filed: Aug. 2, 2017

(86) PCT No.: PCT/JP2017/028128

§ 371 (c)(1),
(2) Date: Feb. 4, 2019

(87) PCT Pub. No.: WO2018/025931

PCT Pub. Date: Feb. 8, 2018

(65) Prior Publication Data

US 2019/0185950 A1 Jun. 20, 2019

(30) Foreign Application Priority Data

Aug. 4, 2016 (JP) ..... JP2016-153914

(51) Int. Cl.

| | |
|---|---|
| ***C21D 6/00*** | (2006.01) |
| ***C22C 45/02*** | (2006.01) |
| ***C22C 38/00*** | (2006.01) |
| ***H01F 1/153*** | (2006.01) |
| ***C22C 33/00*** | (2006.01) |

(52) U.S. Cl.

CPC ..... *C21D 6/00* (2013.01); *C22C 33/003* (2013.01); *C22C 38/00* (2013.01); *C22C 45/02* (2013.01);

(Continued)

(58) Field of Classification Search

CPC ..... C21D 6/00; C22C 33/003; C22C 38/00; C22C 45/02; H01F 1/153

See application file for complete search history.

(56) References Cited

U.S. PATENT DOCUMENTS 4,288,260 A * 9/1981 Senno ..... C21D 9/56 148/100
2001/0007266 A1* 7/2001 Sunakawa ..... C22C 33/003 148/403

(Continued)

FOREIGN PATENT DOCUMENTS

CN 1716465 A 1/2006
EP 2 128 292 A1 12/2009

(Continued)

OTHER PUBLICATIONS

Bi et al ("Temperature dependence of structural and transport property of Cu-free FeCoZrB magnetic films", Thin Solid Films 516 (2008) 2321-2324) (Year: 2008).*

*Primary Examiner* — Robert S Jones, Jr.
*Assistant Examiner* — Jiangtian Xu
(74) *Attorney, Agent, or Firm* — Oliff PLC

(57) ABSTRACT

A method for producing a soft magnetic material having both high saturation magnetization and low coercive force, including: preparing an alloy having a composition represented by Compositional Formula 1 or 2 and having an amorphous phase, and heating the alloy at a rate of temperature rise of 10° C./sec or more and holding for 0 to 80 seconds at a temperature equal to or higher than the crystallization starting temperature and lower than the temperature at which Fe—B compounds start to form wherein, Compositional Formula 1 is $Fe_{100-x-y}B_xM_y$, M represents at least one element selected from Nb, Mo, Ta, W, Ni, Co and Sn, and x and y are in atomic percent (at %) and satisfy the relational expressions of $10 \leq x \leq 16$ and $0 \geq y \leq 8$, and Compo- (Continued)

sitional Formula 2 is $Fe_{100-a-b-c}B_aCu_bM'_c$, M' represents at least one element selected from Nb, Mo, Ta, W, Ni and Co, and a, b and c are in atomic percent (at %) and satisfy the relational expressions $10 \leq a \leq 16$, $0 < b \leq 2$ and $0 \leq c \leq 8$.

6 Claims, 5 Drawing Sheets

(52) U.S. Cl.
CPC ..... *H01F 1/153* (2013.01); *H01F 1/1535* (2013.01); *C22C 2200/02* (2013.01); *C22C 2202/02* (2013.01)

(56) References Cited

U.S. PATENT DOCUMENTS

| | | | | |
|---|---|---|---|---|
| 2010/0098576 | A1* | 4/2010 | Yoshizawa | C22C 38/16 420/82 |
| 2016/0196908 | A1* | 7/2016 | Ohta | C22C 38/12 336/213 |
| 2018/0166213 | A1 | 6/2018 | Makino et al. | |

FOREIGN PATENT DOCUMENTS

| | | | |
|---|---|---|---|
| JP | S54-083622 | A | 7/1979 |
| JP | 2014-240516 | A | 12/2014 |
| WO | 2008/114665 | A1 | 9/2008 |
| WO | 2017/006868 | A1 | 1/2017 |

* cited by examiner

METHOD OF PRODUCING SOFT MAGNETIC MATERIAL

FIELD

The present invention relates to a method for producing a soft magnetic material. More particularly, the present invention relates to a method for producing a soft magnetic material having both high saturation magnetization and low coercive force.

BACKGROUND

Soft magnetic materials used in the cores of components such as motors or reactors are required to demonstrate both high saturation magnetization and low coercive force in order to enhance the performance of these components.

Soft magnetic materials having high saturation magnetization includes Fe-based nanocrystalline soft magnetic materials. Fe-based nanocrystalline soft magnetic materials refer to soft magnetic materials composed mainly of Fe in which nanocrystals are dispersed in the material at 30% by volume or more.

For example, Patent Document 1 discloses an Fe-based nanocrystalline soft magnetic material represented by the compositional formula $Fe_{100-p-q-r-s}Cu_pB_qSi_rSn_s$ (wherein, p, q, r and s are in atomic percent (at %) and satisfy the relational expressions of $0.6 \leq p \leq 1.6$, $6 \leq q \leq 20$, $0 < r \leq 17$ and $0.005 \leq s \leq 24$).

In addition, Patent Document 1 discloses that an Fe-based nanocrystalline soft magnetic material is obtained by heat-treating a thin ribbon having a composition represented by $Fe_{100-p-q-r-s}Cu_pB_qSi_rSn_s$ and amorphous phase.

RELATED ART

Patent Documents

[Patent Document 1] Japanese Unexamined Patent Publication No. 2014-240516

SUMMARY

Problems to be Solved by the Invention

Fe-based nanocrystalline soft magnetic materials have high saturation magnetization since they have Fe as a main component thereof. Fe-based nanocrystalline soft magnetic materials are obtained by heat-treating (it is also referred to "annealing"; the same shall apply hereinafter) a ribbon having an amorphous phase. If the Fe content in the amorphous ribbon is high, a crystalline phase (α-Fe) is easily formed from the amorphous phase and the crystalline phase easily becomes coarse as a result of undergoing grain growth. Therefore, the addition of an element that inhibits grain growth in the material reduces the Fe content in the material corresponding to the amount of that element added, thereby lowering saturation magnetization.

On the basis of the above, the inventors of the present invention found the problem in which, although high saturation magnetization is obtained when the main component of a soft magnetic material is Fe, since a crystalline phase forms from the amorphous phase during heat treatment and that crystalline phase becomes coarse as a result of grain growth, it is difficult to obtain low coercive force.

In order to solve the aforementioned problem, an object of the present invention is to provide a method for producing a soft magnetic material having both high saturation magnetization and low coercive force.

Means to Solve the Problems

The inventors of the present invention make extensive studies to solve the aforementioned problem, thereby leading to completion of the present invention. The gist thereof is as indicated below.

(1) A method for producing a soft magnetic material, comprising:

preparing a alloy having a composition represented by the following Compositional Formula 1 or Compositional Formula 2 and having an amorphous phase, and heating the alloy at a rate of temperature rise of 10° C./sec or more, and holding for 0 to 80 seconds at a temperature equal to or higher than the crystallization starting temperature and lower than the temperature at which Fe—B compounds start to form; wherein, the Compositional Formula 1 is $Fe_{100-x-y}B_xM_y$, M represents at least one element selected from Nb, Mo, Ta, W, Ni, Co and Sn, and x and y are in atomic percent (at %) and satisfy the relational expressions of $10 \leq x \leq 16$ and $0 \leq y \leq 8$, and the Compositional Formula 2 is $Fe_{100-a-b-c}B_aCu_bM'_c$, M' represents at least one element selected from Nb, Mo, Ta, W, Ni and Co, and a, b and c are in atomic percent (at %) and satisfy the relational expressions $10 \leq a \leq 16$, $0 < b \leq 2$ and $0 \leq c \leq 8$.

(2) The method described in (1), wherein the alloy is obtained by quenching a melt.

(3) The method described in (1) or (2), wherein the rate of temperature rise is 125° C./sec or more.

(4) The method described in (1) or (2), wherein the rate of temperature rise is 415° C./sec or more (5) The method described in any one of (1) to (4), wherein the alloy is held for 0 seconds to 17 seconds at the temperature equal to or higher than the crystallization starting temperature and lower than the temperature at which Fe—B compounds start to form.

(6) The method described in any one of (1) to (5), comprising:

clamping the alloy between heated blocks and heating the alloy.

Effects of the Invention

According to the present invention, even if the main component of a alloy having an amorphous phase is Fe in order to obtain high saturation magnetization, by rapidly raising the temperature of that alloy to a temperature equal to or higher than the crystallization starting temperature and lower than the temperature at which Fe—B compounds start to form and then cooling immediately, or holding for a short period of time at that temperature, the crystalline phase becomes increasingly fine allowing the obtaining of low coercive force. In other words, according to the present invention, a method can be provided for producing a soft magnetic material having both high saturation magnetization and low coercive force.

MODE FOR CARRYING OUT THE INVENTION

Figure 1:
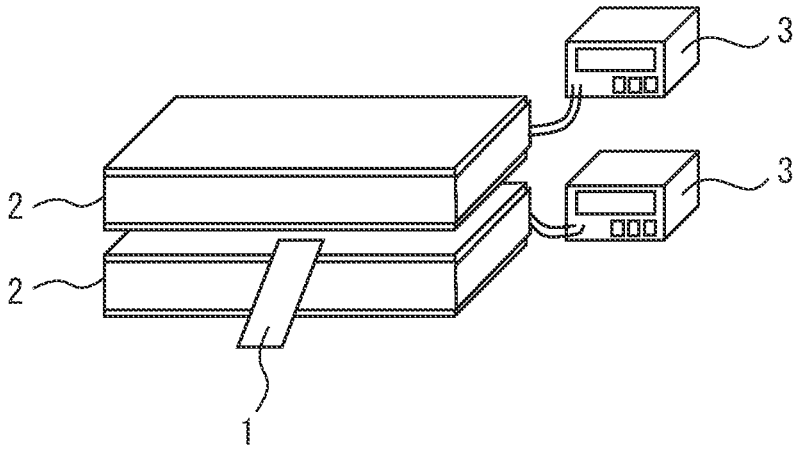
FIG. 1 is a perspective view showing an overview of an apparatus of clamping the alloy between heated blocks in order to heat the alloy.

The following provides a detailed explanation of embodiments of the method for producing a soft magnetic material according to the present invention. Furthermore, the present invention is not limited to the embodiments indicated below.

In order to obtain both high saturation magnetization and low coercive force, a alloy having Fe as the main component thereof and an amorphous phase is rapidly raised to a temperature equal to or higher than the crystallization starting temperature and lower than the temperature at which Fe—B compounds start to form, and then holding at that temperature for a short period of time.

In the present description, "having Fe as the main component thereof" refers to the content of Fe in the material being 50 at % or more. A "alloy having an amorphous phase" refers to a alloy containing 50% by volume or more of an amorphous phase in that alloy, and this may also be simply referred to as an "amorphous alloy". The "alloy" has such forms as ribbon, flake, granules, and bulk and the like.

Although not bound by theory, the following phenomenon is thought to occur in the amorphous alloy when the amorphous alloy is subjected to heat treatment at a temperature equal to or higher than the crystallization starting temperature and lower than the temperature at which Fe—B compounds start to form.

A crystalline phase is formed from the amorphous phase when the amorphous alloy is raise in temperature to a temperature equal to or higher than the crystallization starting temperature. The phenomenon that occurs during the process thereof is explained by dividing into the case in which elements serving as heterogeneous nucleation sites are present in the amorphous alloy, and the case in which such elements are not present in the amorphous alloy. Furthermore, in the present description, elements that serve as heterogeneous nucleation sites are elements that do not readily form a solid solution with Fe.

An example of an element that serves as a heterogeneous nucleation site and that is not soluble in Fe is Cu. When the amorphous alloy contains Cu, Cu becomes a nucleation site, heterogeneous nucleation occurs at these Cu clusters as a starting point, and the crystalline phase is refined. When the amorphous alloy contains Cu, adequate nucleation occurs even in the case of raising the temperature of the amorphous alloy at a low rate (about 1.7° C./sec), and a fine crystalline phase is thought to be obtained.

On the other hand, when an element serving as a heterogeneous nucleation site, such as Cu, is not present in the amorphous alloy, the coarsening of the microstructure is thought to be avoided and a fine crystalline phase is thought to be obtained by rapidly raising the temperature of the amorphous alloy (10° C./sec or more) and cooling immediately or holding at that temperature for a short period of time (0 seconds to 80 seconds). The details thereof are as indicated below. Furthermore, the holding time being 0 second means immediately cooling or stopping holding after rapidly raising the temperature.

The homogeneous nucleation rate is governed by the atomic transport and the critical nucleus size. A high atomic transport and a small critical nucleus size result in a high homogeneous nucleation rate, leading to a finer microstructure. To realize these two conditions, it is effective to induce a supercooled liquid region in the amorphous solid. This is because the viscous flow in supercooled liquid is massive and the strain energy due to nucleation in a supercooled liquid is considerably smaller than that in amorphous solids. Hence, a higher number of embryos becomes nuclei when supercooled liquid regions are realized. However, the conventional annealing results in crystallization of the amorphous solid in relatively low temperatures where the transition from solid to supercooled liquid is limited. Thus, the homogeneous nucleation under conventional heating rates is very limited. Contrarily, the crystallization onset temperature is raised by rapid heating. Hence, a high homogeneous nucleation rate is realized because the amorphous phase is retained at higher temperatures where the transition of the amorphous solid to a supercooled liquid takes place vigorously. As a result, nucleation frequency becomes higher.

The temperature of an amorphous alloy is rapidly raised (10° C./sec or more) to the crystallization starting temperature or higher in order to allow atomic transport to occur resulting in vigorous nucleation in a region formed in a supercooled state as mentioned above. Since the rate of grain growth also increases when the temperature of the amorphous alloy is raised rapidly, the duration of grain growth is shortened by shorting holding time (0 seconds to 80 seconds). From the viewpoint of atomic transport, the temperature of the amorphous alloy is preferably raised to a temperature that is as high as possible beyond the crystallization starting temperature thereof. However, if the temperature of the amorphous alloy reaches the temperature at which Fe—B compounds start to form, those Fe—B compounds are formed. Fe—B compounds increase coercive force due to their large magnetocrystalline anisotropy. Thus, the temperature of the amorphous alloy is preferably rapidly raised to a temperature that is equal to or higher than the crystallization starting temperature and lower than the temperature at which Fe—B compounds start to form.

The temperature of the amorphous alloy is required to be rapidly raised to a temperature range that is equal to or higher than the crystallization starting temperature and lower than the temperature at which Fe—B compounds start to form. However, in the case of slowly raising the temperature of the amorphous alloy to a temperature range lower than the crystallization starting temperature, it is difficult to immediately switch over to rapidly raising the temperature when the temperature of the amorphous alloy has reached the crystallization starting temperature. In addition, there are no particular problems with rapidly raising the temperature of the amorphous alloy in a temperature range lower than the crystallization starting temperature. Thus, the temperature may be increased rapidly starting from when the temperature of the amorphous alloy is lower than the crystallization starting temperature, and the temperature may be continued to be raised rapidly after the amorphous alloy has reached the crystallization starting temperature.

Rapidly raising the temperature as previously described is effective when an element serving as a heterogeneous nucleation site is not present in the amorphous alloy. When an element, such as Cu, serving as a heterogeneous nucleation site is present in the amorphous alloy, it becomes possible to cumulatively obtain the effect of refining crystal grain sizes as a result of Cu serving as a nucleation site, and the effect of refining crystal grains due to remarkable increase of nucleation frequency by rising temperature rapidly.

On the basis of the phenomena explained so far, the inventors of the present invention found that, in order to obtain both high saturation magnetization and low coercive force, an amorphous alloy should be subjected to heat treatment comprising rapidly raising the temperature thereof to a temperature equal to or higher than the crystallization starting temperature and lower than the temperature at which Fe—B compounds start to form followed by immediate cooling or holding at that attained temperature for a short period of time. This heat treatment was found to be effective regardless of whether or not an element serving as a heterogeneous nucleation site, such as Cu, is present in the amorphous alloy.

The following provides an explanation of the configuration of the method for producing a soft magnetic material according to the present invention based on these findings.

(Amorphous Alloy Preparation Step)

A alloy having an amorphous phase (amorphous alloy) is prepared. As previously described, the amorphous phase accounts for 50% by volume or more of the amorphous alloy. From the viewpoint of rapidly raising the temperature of the amorphous alloy and holding at that temperature to obtain more of a fine crystalline phase, the content of the amorphous phase in the amorphous alloy is preferably 60% by volume or more, 70% by volume or more or 90% by volume or more.

The amorphous alloy has a composition represented by Compositional Formula 1 or Compositional Formula 2. An amorphous alloy having a composition represented by Compositional Formula 1 (hereinafter, referred to "amorphous alloy of Compositional Formula 1") does not contain an element that serves as a heterogeneous nucleation site. An amorphous alloy having a composition represented by Compositional Formula 2 (hereinafter, referred to "amorphous alloy of Compositional Formula 2") contains an element that serves as a heterogeneous nucleation site.

Compositional Formula 1 is $Fe_{100-x-y}B_xM_y$. In Compositional Formula 1, M represents at least one element selected from Nb, Mo, Ta, W, Ni, Co and Sn, and x and y satisfy the relational expressions of $10 \leq x \leq 16$ and $0 \leq y \leq 8$. x and y are in atomic percent (at %), x represents the content of B, and y represents the content of M.

The amorphous alloy of Compositional Formula 1 has Fe for the main component thereof, and the Fe content thereof is 50 at % or more. The content of Fe is represented as the remainder of B and M. From the viewpoint of a soft magnetic material, obtained by rapidly raising the temperature of an amorphous alloy and holding at that temperature, having high saturation magnetization, Fe content is preferably 80 at % or more, 84 at % or more or 88 at % or more.

The amorphous alloy is obtained by quenching a melt having Fe as the main component thereof. B (Boron) promotes the formation of an amorphous phase when the melt is quenched. The main phase of the amorphous alloy becomes an amorphous phase if the content of B in an amorphous alloy obtained by quenching the melt is 10 at % or more. As previously described, the main phase of the alloy being an amorphous phase means that the content of the amorphous phase in the alloy is 50% by volume or more. In order to make the main phase of the alloy to be an amorphous phase, the content of B in the amorphous alloy is preferably 11 at % or more and more preferably 12 at % or more. On the other hand, Fe—B compound formation upon crystallization of the amorphous phase can be avoided when the content of B in the amorphous alloy is 16 at % or less. From the view point of avoiding compound formation, the content of B in the amorphous alloy is preferably 15 at % or less and more preferably 14 at % or less.

In addition to Fe and B, the amorphous alloy of Compositional Formula 1 may also contain M as necessary. M is at least one element selected from Nb, Mo, Ta, W, Ni, Co and Sn.

In the case of selecting at least one element from Nb, Mo, Ta, W and Sn among M and an amorphous alloy contain the selected elements, when the temperature of the amorphous alloy is raised rapidly and held at that temperature, grain growth of the crystalline phase is inhibited and increases in coercive force are inhibited. In addition, the amorphous phase remaining in the alloy is stabilized even after having rapidly raised the temperature of the amorphous alloy and holding at that temperature. As a result of the occurrence of atomic transport in a region transitioned to a supercooled state when the temperature of the amorphous alloy is raised rapidly and held at that temperature, the inhibitory effect on the crystalline phase as a result of containing these elements is smaller in comparison with the effect of inhibiting grain growth of the crystalline phase due to the high nucleation frequency. As a result of the amorphous alloy containing these elements, the content of Fe in the amorphous alloy decreases resulting in a decrease saturation magnetization. Thus, the contents of these elements in the amorphous alloy are preferably the minimum required contents.

The magnitude of induced magnetic anisotropy can be controlled when selecting at least one of Ni and Co among M and the amorphous alloy contains these elements. In addition, saturation magnetization can also be increased when the amorphous alloy contains Co.

When the amorphous alloy contains M, the aforementioned action is provided corresponding to the content of M.

In other words, Nb, Mo, Ta, W, Sn and P provide an action that inhibits grain growth of the crystalline phase and stabilizes the amorphous phase, while Ni and Co provide the action of controlling the magnitude of induced magnetic anisotropy and increasing saturation magnetization. From the viewpoint of enabling these actions to be provided clearly, the content of M is preferably 0.2 at % or more and more preferably 0.5 at % or more. On the other hand, when the content of M is 8 at % or less, the amounts of essential elements of Fe and B in the amorphous alloy do not become excessively low, and as a result, a soft magnetic material obtained by rapidly raising the temperature of the amorphous alloy and holding at that temperature is able to have both high saturation magnetization and low coercive force. Furthermore, in the case of having selected two or more elements for M, the content of M is the total content of these elements.

The amorphous alloy of Compositional Formula 1 may also contain unavoidable impurities such as S, O or N in addition to Fe, B and M. An unavoidable impurity refers to an impurity contained in the raw materials for which the containing thereof cannot be avoided, or an impurity that leads to a remarkable increase in production costs when attempted to be avoided. If such an avoidable impurity is contained, the purity of an alloy of Compositional Formula 1 is preferably 97% by mass or more, more preferably 98% by mass or more and even more preferably 99% by mass or more.

Relating to Compositional Formula 2, the following provides an explanation of those matters that differ from the case of Compositional Formula 1.

Compositional Formula 2 is $Fe_{100-a-b-c}B_aCu_bM'_c$. In Compositional Formula 2, M' represents at least one element selected from Nb, Mo, Ta, W, Ni and Co, and a, b and c respectively satisfy the relational expressions $10 \leq a \leq 16$, $0 < b \leq 2$ and $0 \leq c \leq 8$. a, b and c are in in atomic percent (at %), a represents the content of B, b represents the content of Cu, and c represents the content of M'.

The amorphous alloy of Compositional Formula 2 has Cu for an essential component thereof in addition to Fe and B. In addition to Fe, B and Cu, the amorphous alloy of Compositional Formula 2 may also contain M' as necessary. M' is at least one element selected from Nb, Mo, Ta, W, Ni and Co.

When the amorphous alloy contains Cu, the Cu becomes a nucleation site during the temperature of amorphous alloy being raised rapidly and held at that temperature, heterogeneous nucleation occurs with its starting point in Cu clusters, and the crystalline phase grains becomes fine. Even if the content of Cu in the amorphous alloy is extremely low, the effect of grain refinement of the crystalline phase is comparatively large. In order to make this effect clearer, the content of Cu in the amorphous alloy is preferably 0.2 at % or more and more preferably 0.5 at % or more. On the other hand, when the Cu content in the amorphous alloy is 2 at % or less an amorphous alloy can be produced by rapid quenching of the melt without the formation of a crystalline phase. From the viewpoint of embrittlement of the amorphous alloy, the Cu content in the amorphous alloy is preferably 1 at % or less and more preferably 0.7 at % or less.

The amorphous alloy of Compositional Formula 2 may also contain unavoidable impurities such as S, O and N in addition to Fe, B, Cu and M'. An unavoidable impurity refers to an impurity contained in the raw materials for which the containing thereof cannot be avoided, or an impurity that leads to a remarkable increase in production costs when attempted to be avoided. The purity of the amorphous alloy of Compositional Formula 2 when such an avoidable impurity is contained is preferably 97% by mass or more, more preferably 98% by mass or more and even more preferably 99% by mass or more.

(Rapidly Raising Temperature of Amorphous Alloy and Holding at that Temperature)

The amorphous alloy is heated at a rate of temperature rise of 10° C./sec or more and is held for 0 to 80 seconds at a temperature equal to or higher than the crystallization starting temperature and lower than the temperature at which Fe—B compounds start to form.

The crystalline phase does not become coarse when the rate of temperature rise is 10° C./sec or more. Since a higher rate of temperature rise is preferable from the viewpoint of avoiding increased coarseness of the crystalline phase, the rate of temperature rise may be 45° C./sec or more, 125° C./sec or more, or 150° C./sec or more, 415° C./sec or more. On the other hand, when the rate of temperature rise is extremely rapid, the heat source for heating becomes excessively large, thereby impairing economic feasibility. From the viewpoint of the heat source, the rate of temperature rise is preferably 415° C./sec or less. The rate of temperature rise may be an average rate from heating start to holding start. When the holding time is 0 sec, it may be an average rate from heating start to cooling start. Alternatively, it may be an average rate between certain temperature range, for example, the temperature range from 100° C. to 400° C.

When the holding time is 0 seconds or more, a fine crystalline phase can be obtained from the amorphous phase. Furthermore, the holding time being 0 second means immediately cooling or stopping holding after rapidly raising the temperature. On the other hand, when the holding time is 80 seconds or less, increased coarseness of the crystalline phase can be avoided. From the viewpoint of avoiding increased coarseness of the crystalline phase, the holding time is 60 seconds or less, 40 seconds or less, 20 seconds or less, or 14 seconds.

The amorphous phase can be converted to a crystalline phase when the holding temperature is equal to or higher than the crystallization starting temperature. Holding temperature can be raised since the duration of holding is short. Holding temperature is suitably determined in consideration of the balance with holding time. On the other hand, strong magnetocrystalline anisotropy occurs due to the formation Fe—B compounds when the holding temperature exceeds the temperature at which Fe—B compounds start to form, and coercive force increases as a result thereof. Thus, by holding at the highest temperature that does not reach the temperature at which Fe—B compounds start to form, the crystalline phase can be refined without forming Fe—B compounds. The temperature of the amorphous alloy may be held at a temperature that is just lower than the temperature at which Fe—B compounds start to form in order to refine crystalline phase in this manner. A temperature just lower than the temperature at which Fe—B compounds start to form refers to a temperature that is 5° C. or less lower than the temperature at which Fe—B compounds start to form, a temperature that is 10° C. or less lower than the temperature at which Fe—B compounds start to form, or a temperature that is 20° C. or less lower than the temperature at which Fe—B compounds start to form.

There are no particular limitations on the heating method provided the amorphous alloy can be heated at the previously explained rate of temperature rise.

When the amorphous alloy is heated using an ordinary atmosphere furnace, it is effective to make the rate of temperature rise of the oven atmosphere higher than the desired rate of temperature rise of the amorphous alloy. Similarly, it is effective to make the atmospheric temperature in the furnace to be higher than the desired holding temperature of the amorphous alloy. For example, when raising the temperature of the amorphous alloy at the rate of 150° C./sec and holding the amorphous alloy at 500° C., it is effective to raise the temperature of the atmosphere in the furnace at 170° C./sec and hold the temperature the atmosphere in the furnace at 520° C.

A time-lag between the amount of heat supplied from an infrared heater and amount of heat received to the amorphous alloy can be reduced by using an infrared furnace. Furthermore, an infrared furnace refers to a furnace that rapidly heats a heated object by reflecting light emitted from an infrared lamp with a concave surface.

Moreover, the temperature of the amorphous alloy may be rapidly raised and held using heat transfer between solids. FIG. 1 is a perspective view showing an overview of an apparatus that rapidly raises the temperature of an amorphous alloy and holds the alloy at that temperature by clamping the amorphous alloy between blocks which have already been heated to the required holding temperature.

An amorphous alloy is positioned so that it can be clamped by the blocks 2. The blocks 2 are provided with a heating element (not shown). Temperature controllers 3 are coupled to the heating element. The amorphous alloy 1 can be heated by clamping the preheated blocks onto the alloy so that heat transfer between solids can take place, in other words, between the amorphous alloy 1 and the blocks 2. There are no particular limitations on the material and so forth of the blocks 2 provided heat is efficiently transferred between the amorphous alloy 1 and the blocks 2. Examples of materials of the blocks 2 include metal, alloy and ceramics and the like.

When the temperature of the amorphous alloy is raised at a rate of 100° C. or more, the amorphous alloy per se generates heat due to heat released during crystallization of the amorphous phase. When the temperature of the amorphous alloy is rapidly raised using an atmosphere furnace or infrared furnace and the like, it is difficult to control temperature in consideration of generation of heat by the amorphous alloy per se. Consequently, in the case of using an atmosphere furnace or infrared furnace and the like, the temperature of the amorphous alloy is often higher than the target temperature, thereby resulting in increased coarseness of the crystalline phase. In contrast, as shown in FIG. 1, as a result of clamping the amorphous alloy 1 between the heated blocks 2, it becomes easy to control temperature in consideration of generation of heat by the amorphous alloy per se when the amorphous alloy 1 is heated. Consequently, when the amorphous alloy is rapidly raised in temperature as shown in FIG. 1, the temperature of the amorphous alloy does not exceed the target temperature and increased coarseness of the crystalline phase can be avoided.

In addition, when the temperature of the amorphous alloy is raised rapidly as shown in FIG. 1, since the temperature of the amorphous alloy can be precisely controlled, the amorphous alloy can be held at a temperature just below the temperature which Fe—B compounds start to form, and the crystalline phase can be made to be fine without forming Fe—B compounds.

(Method for Producing an Amorphous Alloy)

Next, an explanation is provided of the method for producing the amorphous alloy. There are no particular limitations on the method used to produce the amorphous alloy provided an amorphous alloy having a composition represented by the aforementioned Compositional Formula 1 or Compositional Formula 2 is obtained. As mentioned above, the alloy has such forms as ribbon, flake, granules, and bulk and the like. The method for producing amorphous alloy can be suitably selected in order to obtain desired forms.

A method for producing the amorphous alloy includes a method comprising preparing in advance an ingot in which the amorphous alloy is provided so as to have a composition represented by Compositional Formula 1 or Compositional Formula 2, and quenching a melt obtained by melting this ingot to obtain an amorphous alloy. When there is wastage of elements when melting the ingot, an ingot is prepared having a composition that anticipates that wastage. In addition, when melting the ingot after crushing, the ingot is preferably subjected to homogenization heat treatment prior to crushing.

The method of quenching the melt may be an ordinary method, and an example thereof includes a single roll method that uses a cooling roll made of copper or a copper alloy and the like. The peripheral velocity of the cooling roll in a single roll method may be the standard peripheral velocity when producing an amorphous alloy including Fe as the main component thereof. The peripheral velocity of the cooling roll is, for example, 15 m/sec or more, 30 m/sec or more or 40 m/sec or more and 55 m/sec or less, 70 m/sec or less or 80 m/sec or less.

The temperature of the melt when discharging the melt to the single roll is preferably 50° C. to 300° C. higher than the melting point of the ingot. Although there are no particular limitations on the atmosphere when discharging the melt, the atmosphere is preferably that of an inert gas and the like from the viewpoint of reducing contamination of the amorphous alloy by oxides and the like.

EXAMPLES

The following provides a more detailed explanation of the present invention through examples thereof. Furthermore, the present invention is not limited to these examples.

(Preparation of Amorphous Alloy)

Raw materials were weighed out so as to have the prescribed composition, and after arc melting the raw materials, the melt was cast in a mold to prepare an ingot. High purity Fe powder, Fe—B alloy and pure Cu powder were used for the raw materials.

The crushed ingot is charged into the nozzle of a liquid rapid cooling apparatus (single roll method) and then melted by high-frequency induction heating to obtain a melt. The melt is then discharged onto a copper roll having a peripheral velocity of 40 m/s to 70 m/s to obtain an amorphous alloy having a width of 1 mm or more. Furthermore, the amorphous alloy was subjected to X-ray diffraction (XRD) analysis prior to the heat treatment to be subsequently described. In addition, the crystallization starting temperature, the temperature at which Fe—B compounds start to form and the curie temperature of the amorphous phase were measured. Differential thermal analysis (DTA) and thermo-magneto-gravimetric analysis (TMGA) were used for these measurements.

(Heat Treatment of Amorphous Alloy)

As shown in FIG. 1, the amorphous alloy was clamped between heated blocks followed by heating the amorphous alloy for a certain amount of time. As a result of this heating, the amorphous phase in the amorphous alloy was crystallized for use as a sample of a soft magnetic material.

Figure 2:
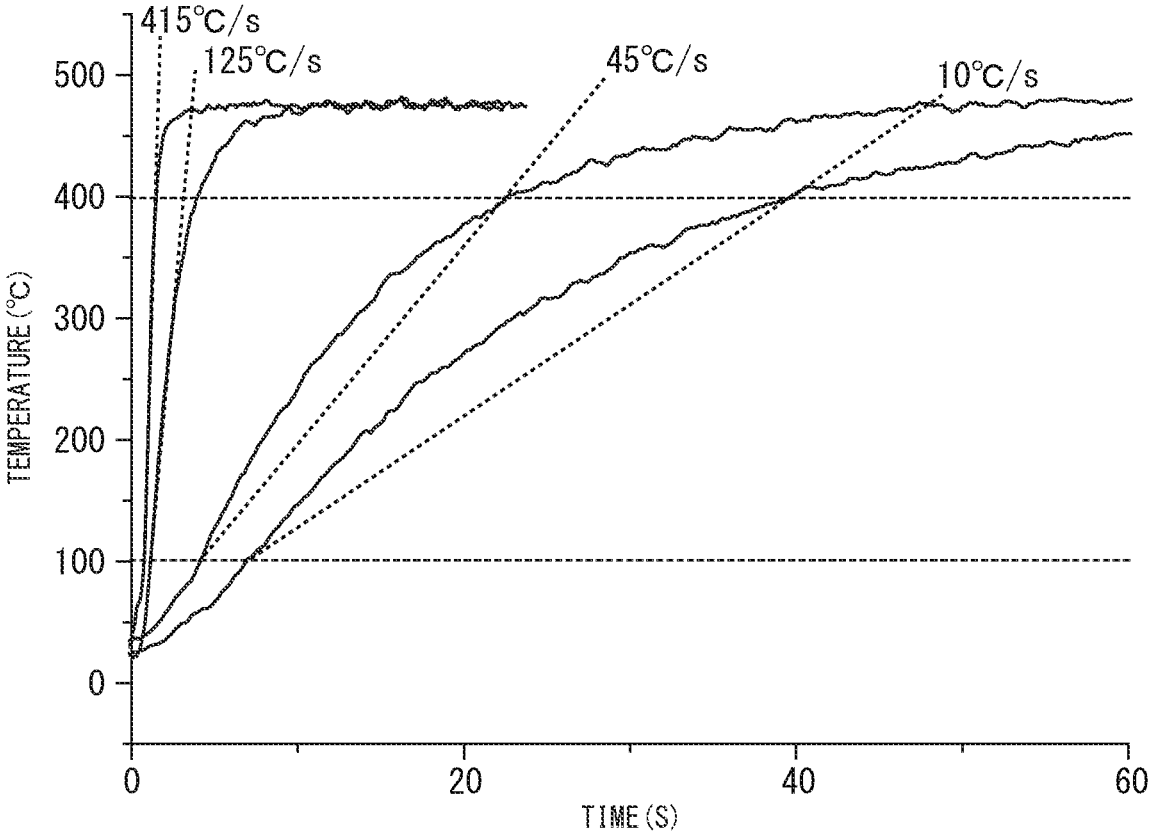
FIG. 2 is a graph indicating the relationship between heating time and temperature of an amorphous alloy when heating the amorphous alloy.

Furthermore, the rate of temperature rise was based off the temperature range between 100° C. to 400° C. as shown in FIG. 2.

(Evaluation of Samples)

Heat-treated samples were evaluated in the manner described below. Saturation magnetization was measured using a vibrating sample magnetometer (VSM) (maximum applied magnetic field: 10 kOe). Coercive force was measured using a direct current BH analyzer. The crystalline phase was identified by XRD analysis.

Evaluation results are shown in Table 1. Table 1 indicates the compositions of the amorphous alloys, heating conditions, crystallization starting temperatures, temperatures at which Fe—B compounds start to form, and curie temperatures of the amorphous phase.

TABLE 1

| | Composition | Holding temperature Tc ° C. | Rate of temperature rise ° C./sec | Holding time sec | Atmosphere | Coercive force Hc A/m | Saturation magnetization Js T | Crystallization starting temperature Tx1 ° C. | Starting temperature of Fe—B compound formation Tx2 ° C. | Tx2 − Tx1 ° C. | Amorphous phase curie temperature Tc ° C. |
|---|---|---|---|---|---|---|---|---|---|---|---|
| Example 1 | $Fe_{83}B_{12}Nb_4Cu_1$ | 552 | 415 | 17 | Air | 5.0 | 1.63 | 414 | 647 | 233 | 142 |
| Example 2 | $Fe_{83}B_{13}Nb_3Cu_1$ | 552 | 415 | 17 | Air | 7.0 | 1.68 | 409 | 583 | 174 | 187 |
| Example 3 | $Fe_{84}B_{12}Nb_3Cu_1$ | 552 | 415 | 17 | Air | 5.0 | 1.69 | 395 | 586 | 191 | 165 |
| Example 4 | $Fe_{83}B_{14}Nb_2Cu_1$ | 533 | 415 | 17 | Air | 6.0 | 1.71 | 404 | 549 | 145 | 234 |
| Example 5 | $Fe_{84}B_{13}Nb_2Cu_1$ | 524 | 415 | 17 | Air | 7.0 | 1.74 | 390 | 546 | 156 | 213 |
| Example 6 | $Fe_{85}B_{12}Nb_2Cu_1$ | 533 | 415 | 17 | Air | 13.0 | 1.80 | 356 | 548 | 192 | 186 |
| Example 7 | $Fe_{84}B_{14}Nb_1Cu_1$ | 495 | 415 | 17 | Air | 6.8 | 1.75 | 393 | 516 | 123 | 261 |
| Example 8 | $Fe_{85}B_{13}Nb_1Cu_1$ | 484 | 415 | 17 | Air | 4.4 | 1.81 | 378 | 517 | 139 | 238 |
| Example 9 | $Fe_{86}B_{12}Nb_1Cu_1$ | 486 | 415 | 17 | Air | 19.0 | 1.87 | 346 | 516 | 170 | 214 |
| Example 10 | $Fe_{86}B_{13}Cu_1$ | 467 | 415 | 17 | Air | 10.2 | 1.88 | 365 | 483 | 118 | 269 |
| Example 11 | $Fe_{87}B_{12}Cu_1$ | 472 | 415 | 0 | Ar | 12.1 | 1.89 | 342 | 486 | 144 | 247 |
| Example 12 | $Fe_{87}B_{13}$ | 472 | 415 | 0 | Ar | 8.8 | 1.87 | 382 | 488 | 106 | 247 |
| Example 13 | $Fe_{86.8}B_{13}Cu_{0.2}$ | 472 | 415 | 0 | Ar | 6.9 | 1.89 | 380 | 489 | 109 | 260 |
| Example 14 | $Fe_{86.5}B_{13}Cu_{0.5}$ | 472 | 415 | 0 | Ar | 6.1 | 1.89 | 375 | 484 | 109 | 262 |
| Example 15 | $Fe_{86}B_{13}Cu_1$ | 472 | 415 | 0 | Ar | 5.1 | 1.88 | 365 | 482 | 117 | 265 |
| Example 16 | $Fe_{85.5}B_{13}Cu_{1.5}$ | 472 | 415 | 0 | Ar | 3.3 | 1.88 | 356 | 481 | 125 | 282 |
| Example 17 | $Fe_{85}B_{14}Cu_1$ | 472 | 415 | 0 | Ar | 5.5 | 1.88 | 387 | 489 | 102 | 273 |
| Example 18 | $Fe_{84}B_{15}Cu_1$ | 472 | 415 | 0 | Ar | 5.7 | 1.88 | 397 | 489 | 92 | 302 |
| Example 19 | $Fe_{83}B_{12}Nb_4Cu_1$ | 552 | 415 | 0 | Ar | 1.5 | 1.63 | 414 | 647 | 233 | 142 |
| Example 20 | $Fe_{83}B_{13}Nb_3Cu_1$ | 552 | 415 | 0 | Ar | 1.7 | 1.69 | 409 | 583 | 174 | 187 |
| Example 21 | $Fe_{84}B_{12}Nb_3Cu_1$ | 552 | 415 | 0 | Ar | 2.0 | 1.70 | 395 | 586 | 191 | 165 |
| Example 22 | $Fe_{83}B_{14}Nb_2Cu_1$ | 533 | 415 | 0 | Ar | 1.4 | 1.70 | 404 | 549 | 145 | 234 |
| Example 23 | $Fe_{84}B_{13}Nb_2Cu_1$ | 524 | 415 | 0 | Ar | 2.4 | 1.75 | 390 | 546 | 156 | 213 |
| Example 24 | $Fe_{85}B_{12}Nb_2Cu_1$ | 533 | 415 | 0 | Ar | 10.5 | 1.79 | 356 | 548 | 192 | 186 |
| Example 25 | $Fe_{84}B_{14}Nb_2Cu_1$ | 495 | 415 | 0 | Ar | 2.8 | 1.75 | 393 | 516 | 123 | 261 |
| Example 26 | $Fe_{85}B_{13}Nb_1Cu_1$ | 486 | 415 | 0 | Ar | 2.5 | 1.80 | 378 | 517 | 139 | 238 |
| Example 27 | $Fe_{86}B_{12}Nb_1Cu_1$ | 486 | 415 | 0 | Ar | 17.0 | 1.73 | 346 | 516 | 170 | 214 |
| Example 28 | $Fe_{85.8}B_{13}Nb0_{.2}Cu_1$ | 467 | 415 | 0 | Ar | 4.0 | 1.82 | 362 | 489 | 127 | 248 |
| Example 29 | $Fe_{85.5}B_{12}Nb_{0.5}Cu_1$ | 477 | 415 | 0 | Ar | 4.0 | 1.83 | 365 | 499 | 134 | 244 |
| Example 30 | $Fe_{85.3}B_{13}Nb_{0.7}Cu_1$ | 477 | 415 | 0 | Ar | 5.2 | 1.81 | 399 | 506 | 107 | 240 |
| Example 31 | $Fe_{86}B_{13}Nb_1$ | 495 | 415 | 0 | Ar | 5.7 | 1.89 | 379 | 526 | 147 | 211 |
| Example 32 | $Fe_{84}B_{13}Nb_3$ | 533 | 415 | 0 | Ar | 7.2 | 1.75 | 420 | 569 | 149 | 166 |
| Example 33 | $Fe_{86}B_{13}Nb_1$ | 495 | 415 | 0 | Ar | 6.8 | 1.80 | 381 | 509 | 128 | 207 |
| Example 34 | $Fe_{86.5}B_{13}Mo_{0.5}Cu_1$ | 495 | 415 | 0 | Ar | 10.8 | 1.83 | 368 | 492 | 124 | 240 |
| Example 35 | $Fe_{85}B_{13}Mo_1Cu_1$ | 495 | 415 | 0 | Ar | 9.8 | 1.85 | 374 | 495 | 121 | 242 |
| Example 36 | $Fe_{84}B_{13}Mo_2Cu_1$ | 495 | 415 | 0 | Ar | 2.9 | 1.70 | 386 | 425 | 138 | 189 |
| Example 37 | $Fe_{86}B_{13}Ta_1$ | 514 | 415 | 0 | Ar | 6.4 | 1.83 | 391 | 532 | 141 | 210 |
| Example 38 | $Fe_{85}B_{13}Ta_1Cu_1$ | 505 | 415 | 0 | Ar | 5.2 | 1.75 | 377 | 529 | 152 | 224 |
| Example 39 | $Fe_{84}B_{13}Ta_2Cu_1$ | 505 | 415 | 0 | Ar | 5.5 | 1.77 | 387 | 553 | 166 | 208 |
| Example 40 | $Fe_{86}B_{13}W_1$ | 486 | 415 | 0 | Ar | 8.5 | 1.89 | 382 | 508 | 126 | 207 |
| Example 41 | $Fe_{85}B_{13}W_1Cu_1$ | 486 | 415 | 0 | Ar | 2.1 | 1.85 | 380 | 506 | 126 | 225 |
| Example 42 | $Fe_{86.5}B_{12}Ni_1Cu_{0.5}$ | 472 | 415 | 0 | Ar | 5.5 | 1.90 | 379 | 489 | 110 | 279 |
| Example 43 | $Fe_{86}B_{13}Ni_1$ | 467 | 415 | 0 | Ar | 8.7 | 1.94 | 355 | 489 | 134 | 252 |
| Example 44 | $Fe_{84}B_{13}Ni_3$ | 467 | 415 | 0 | Ar | 5.9 | 1.93 | 356 | 485 | 129 | 295 |
| Example 45 | $Fe_{80}B_{13}Ni_7$ | 467 | 415 | 0 | Ar | 4.1 | 1.85 | 352 | 484 | 132 | 353 |
| Example 46 | $Fe_{85.5}B_{13}Ni_1Cu_{0.5}$ | 472 | 415 | 0 | Ar | 5.1 | 1.89 | 369 | 483 | 114 | 284 |
| Example 47 | $Fe_{85}B_{13}Ni_1Cu_1$ | 472 | 415 | 0 | Ar | 2.5 | 1.91 | 369 | 483 | 114 | 287 |
| Example 48 | $Fe_{83.5}B_{13}Ni_3Cu_{0.5}$ | 472 | 415 | 0 | Ar | 2.6 | 1.90 | 375 | 482 | 107 | 313 |
| Example 49 | $Fe_{84.5}B_{14}Ni_3Cu_{0.5}$ | 472 | 415 | 0 | Ar | 9.6 | 1.89 | 380 | 489 | 109 | 285 |
| Example 50 | $Fe_{83.5}B_{15}Ni_3Cu_{0.5}$ | 472 | 415 | 0 | Ar | 12.1 | 1.85 | 403 | 488 | 85 | 311 |
| Example 51 | $Fe_{85.5}Co_1B_{13}Cu_{0.5}$ | 477 | 415 | 0 | Ar | 4.9 | 1.91 | 371 | 487 | 116 | 285 |
| Example 52 | $Fe_{85}Co_1B_{13}Cu_1$ | 477 | 415 | 0 | Ar | 4.3 | 1.90 | 374 | 487 | 113 | 295 |
| Example 53 | $Fe_{87}B_{12}Nb_1$ | 514 | 415 | 0 | Ar | 11.5 | 1.89 | 360 | 526 | 166 | 148 |
| Example 54 | $Fe_{86}B_{12}Nb_2$ | 552 | 415 | 0 | Ar | 7.8 | 1.83 | 382 | 560 | 178 | 164 |
| Example 55 | $Fe_{85}B_{12}Nb_3$ | 561 | 415 | 0 | Ar | 5.8 | 1.75 | 400 | 574 | 174 | 139 |
| Example 56 | $Fe_{84}B_{12}Nb_4$ | 580 | 415 | 0 | Ar | 6.5 | 1.68 | 428 | 593 | 165 | 122 |
| Example 57 | $Fe_{85}B_{13}Nb_2$ | 533 | 415 | 0 | Ar | 6.2 | 1.75 | 401 | 559 | 158 | 184 |
| Example 58 | $Fe_{83}B_{13}Nb_4$ | 590 | 415 | 0 | Ar | 9.8 | 1.68 | 439 | 591 | 152 | 138 |
| Example 59 | $Fe_{82}B_{13}Nb_5$ | 609 | 415 | 0 | Ar | 10.7 | 1.56 | 474 | 604 | 130 | 111 |
| Example 60 | $Fe_{85}B_{14}Nb_1$ | 514 | 415 | 0 | Ar | 5.8 | 1.84 | 403 | 522 | 130 | 239 |
| Example 61 | $Fe_{84}B_{14}Nb_2$ | 524 | 415 | 0 | Ar | 5.4 | 1.77 | 415 | 550 | 130 | 210 |

TABLE 1-continued

| | Composition | Holding temperature Tc ° C. | Rate of temperature rise ° C./sec | Holding time sec | Atmosphere | Coercive force Hc A/m | Saturation magnetization Js T | Crystallization starting temperature Tx1 ° C. | Starting temperature of Fe—B compound formation Tx2 ° C. | Tx2 − Tx1 ° C. | Amorphous phase curie temperature Tc ° C. |
|---|---|---|---|---|---|---|---|---|---|---|---|
| Example 62 | $Fe_{85}B_{15}$ | 439 | 415 | 0 | Ar | 16.2 | 1.85 | 416 | 464 | 48 | 285 |
| Example 63 | $Fe_{84}B_{15}Sn_1$ | 467 | 415 | 0 | Ar | 30.1 | 1.83 | 421 | 493 | 72 | 305 |
| Example 64 | $Fe_{82}B_{15}Sn_3$ | 467 | 415 | 0 | Ar | 17.1 | 1.83 | 431 | 498 | 67 | 352 |
| Comp. Ex. 1 | $Fe_{86}B_{13}Cu_1$ | 460 | 1.7 | 300 | Vacuum | 79.3 | 1.88 | 365 | 483 | 118 | 269 |

The evaluation results were summarized indicated below in FIGS. 3 to 9.

Figure 3:
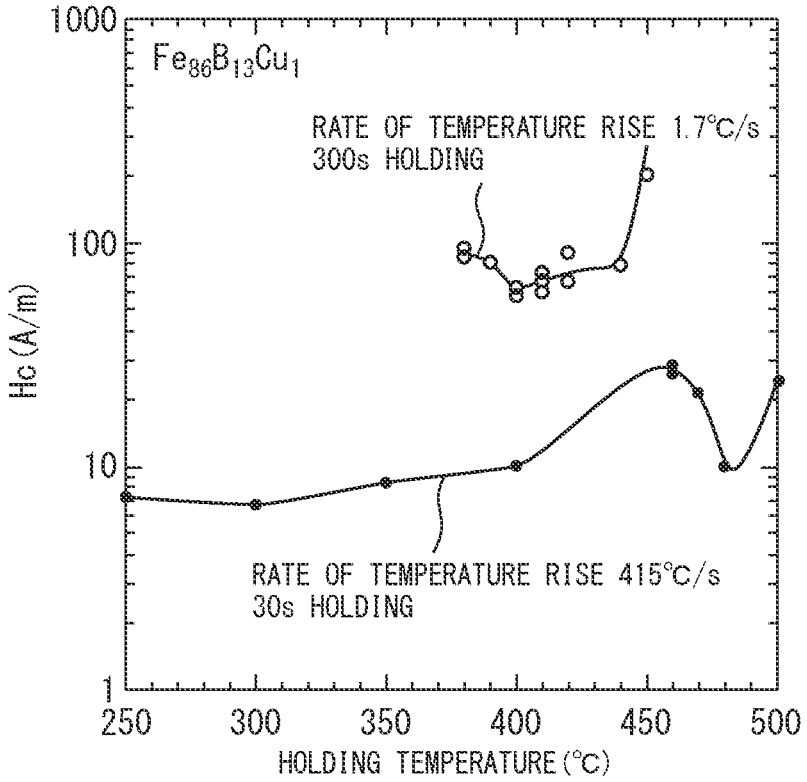
FIG. 3 is a graph indicating the relationship between holding temperature and coercive force when an amorphous alloy having the composition $B_{86}B_{13}Cu_1$ was subjected to heat treatment.
Figure 4:
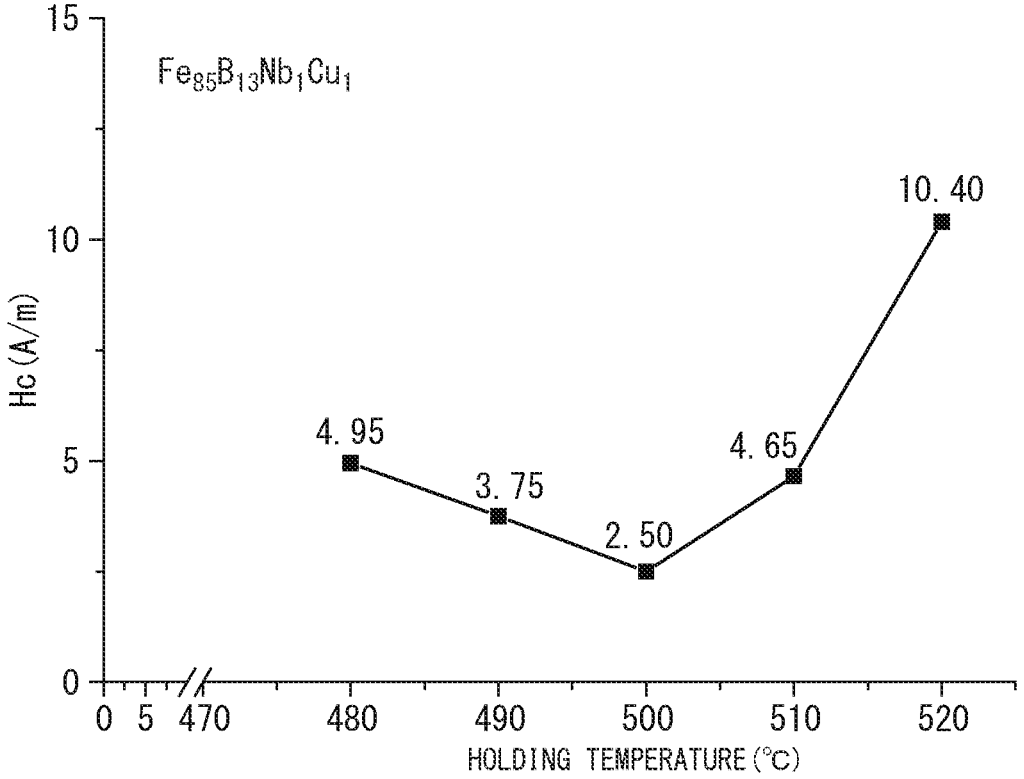
FIG. 4 is a graph indicating the relationship between holding temperature and coercive force when an amorphous alloy having the composition $Fe_{85}B_{13}Nb_1Cu_1$ was subjected to heat treatment (rate of temperature rise: 415° C./sec, holding time: 0 sec).
Figure 5:
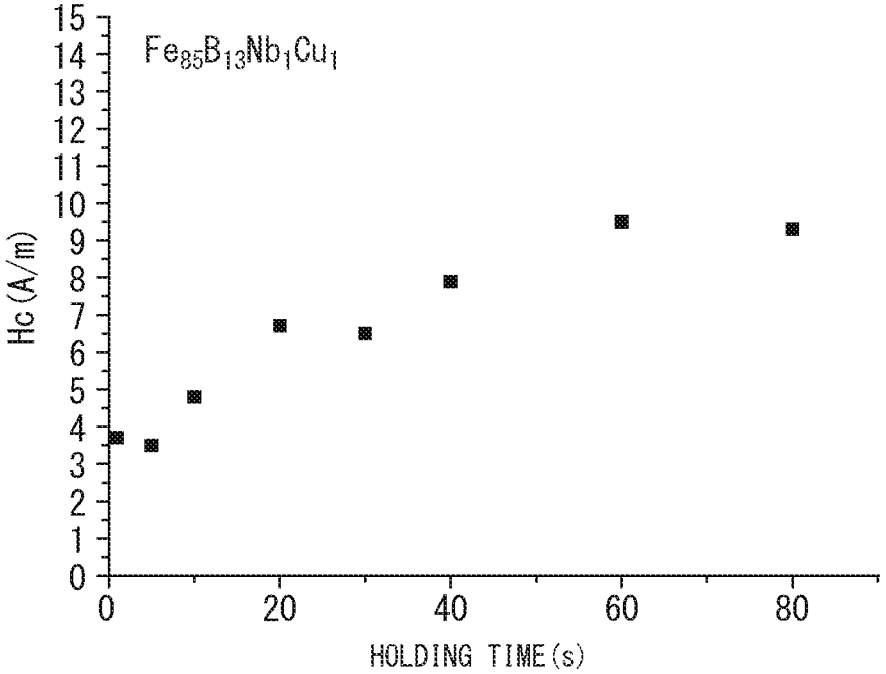
FIG. 5 is a graph indicating the relationship between holding time and coercive force when an amorphous alloy having the composition $Fe_{85}B_{13}Nb_1Cu_1$ was subjected to heat treatment (rate of temperature rise: 415° C./sec, holding temperature: 500° C.).
Figure 6:
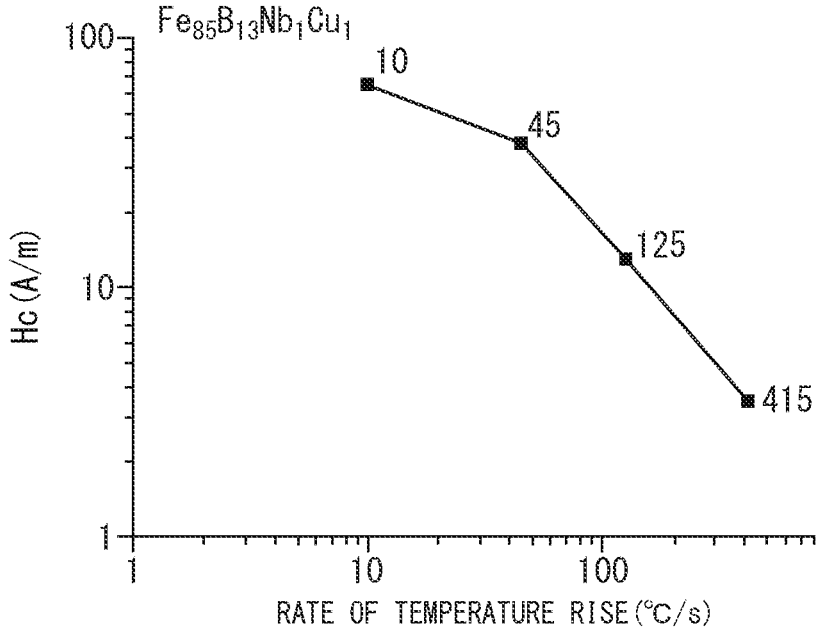
FIG. 6 is a graph indicating the relationship between rate of temperature rise and coercive force when an amorphous alloy having the composition $Fe_{85}B_{13}Nb_1Cu_1$ was subjected to heat treatment (holding temperature: 500° C., holding time: varied from 0 to 80 sec).

FIG. 3 is a graph indicating the relationship between holding temperature and coercive force when an amorphous alloy having the composition $B_{86}B_{13}Cu_1$ was subjected to heat treatment. FIG. 4 is a graph indicating the relationship between holding temperature and coercive force when an amorphous alloy having the composition $Fe_{85}B_{13}Nb_1Cu_1$ was subjected to heat treatment (rate of temperature rise: 415° C./sec, holding time: 0 sec). FIG. 5 is a graph indicating the relationship between holding time and coercive force when an amorphous alloy having the composition $Fe_{85}B_{13}Nb_1Cu_1$ was subjected to heat treatment (rate of temperature rise: _415° C./sec, holding temperature: 500_° C.). FIG. 6 is a graph indicating the relationship between rate of temperature rise and coercive force when an amorphous alloy having the composition $Fe_{85}B_{13}Nb_1Cu_1$ was subjected to heat treatment (holding temperature: 500° C., holding time: Varied 0 to 80_sec).

Figure 7:
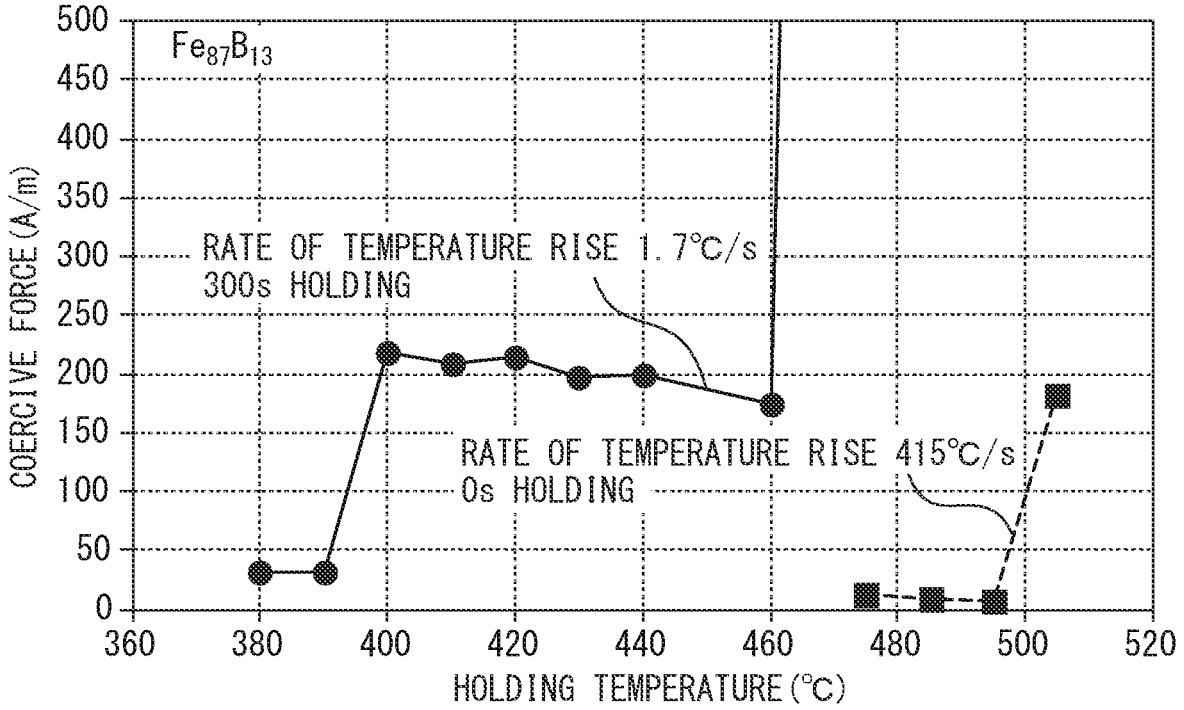
FIG. 7 is a graph indicating the relationship between holding temperature and coercive force when an amorphous alloy having the composition $Fe_{87}B_{13}$ was subjected to heat treatment.
Figure 8:
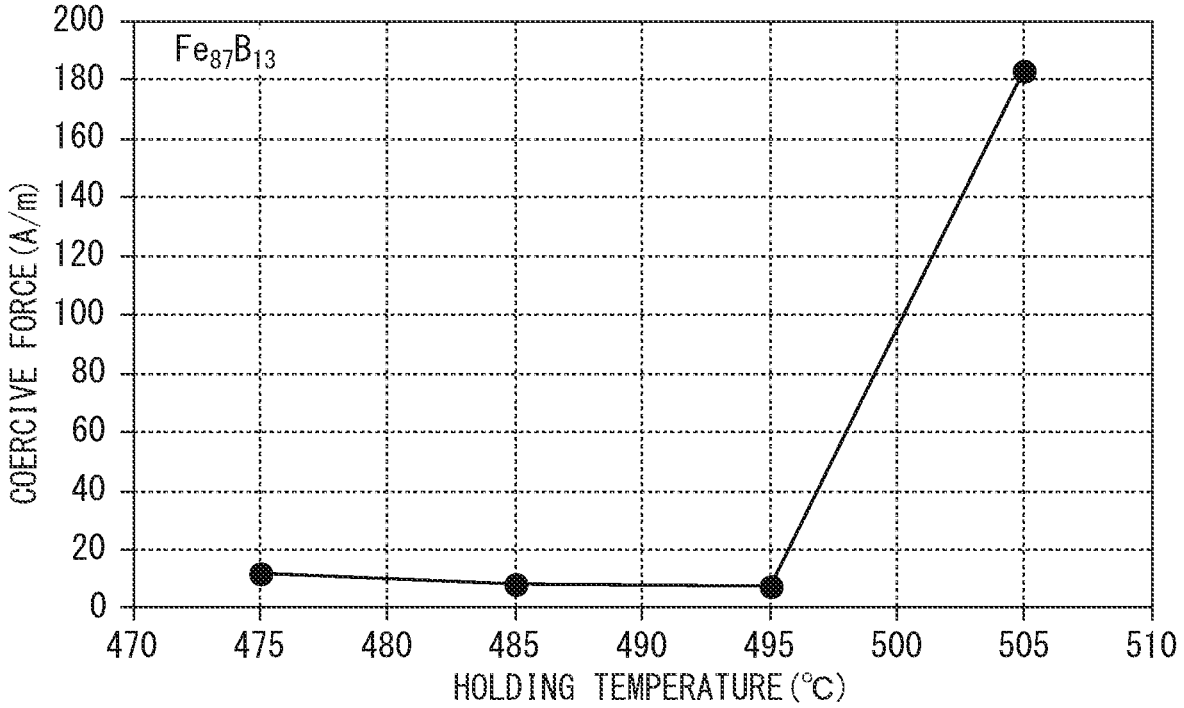
FIG. 8 is a graph indicating the relationship between holding temperature and coercive force when an amorphous alloy having the composition $Fe_{87}B_{13}$ was subjected to heat treatment (rate of temperature rise: 415° C./sec, holding time: 0 sec).
Figure 9:
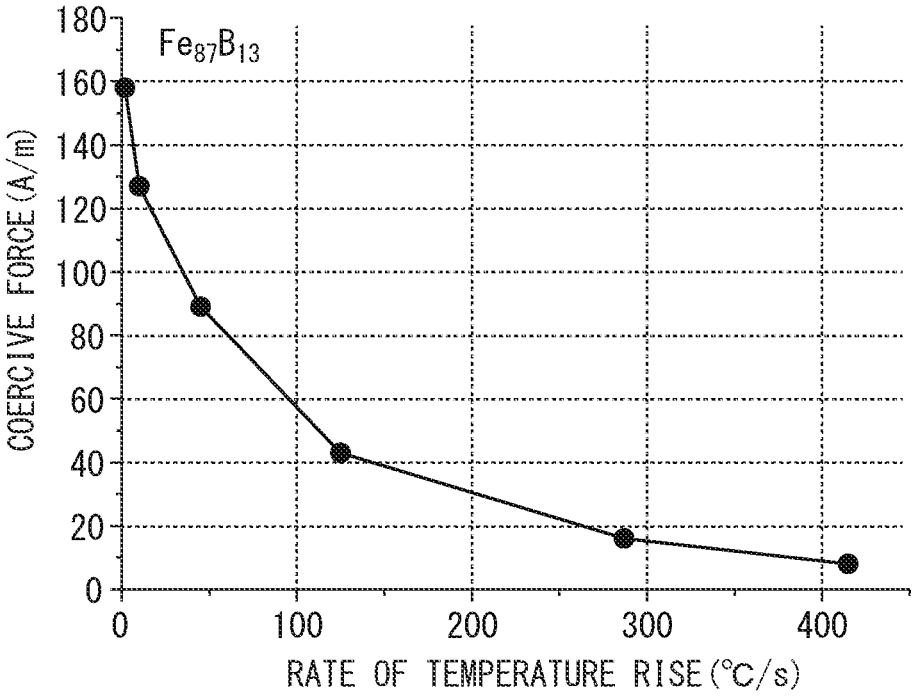
FIG. 9 is a graph indicating the relationship between rate of temperature rise and coercive strength when an amorphous alloy having the composition $Fe_{87}B_{13}$ was subjected to heat treatment (holding temperature: 485° C., holding time: Varied from 0 to 30 sec).

FIG. 7 is a graph indicating the relationship between holding temperature and coercive force when an amorphous alloy having the composition $Fe_{87}B_{13}$ was subjected to heat treatment. FIG. 8 is a graph indicating the relationship between holding temperature and coercive force when an amorphous alloy having the composition $Fe_{87}B_{13}$ was subjected to heat treatment (rate of temperature rise: 485 C/sec, holding time: varied 0 to 30 sec). FIG. 9 is a graph indicating the relationship between rate of temperature rise and coercive strength when an amorphous alloy having the composition $Fe_{87}B_{13}$ was subjected to heat treatment (holding temperature: 485° C., holding time: varied 0 to 30 sec).

Figure 10:
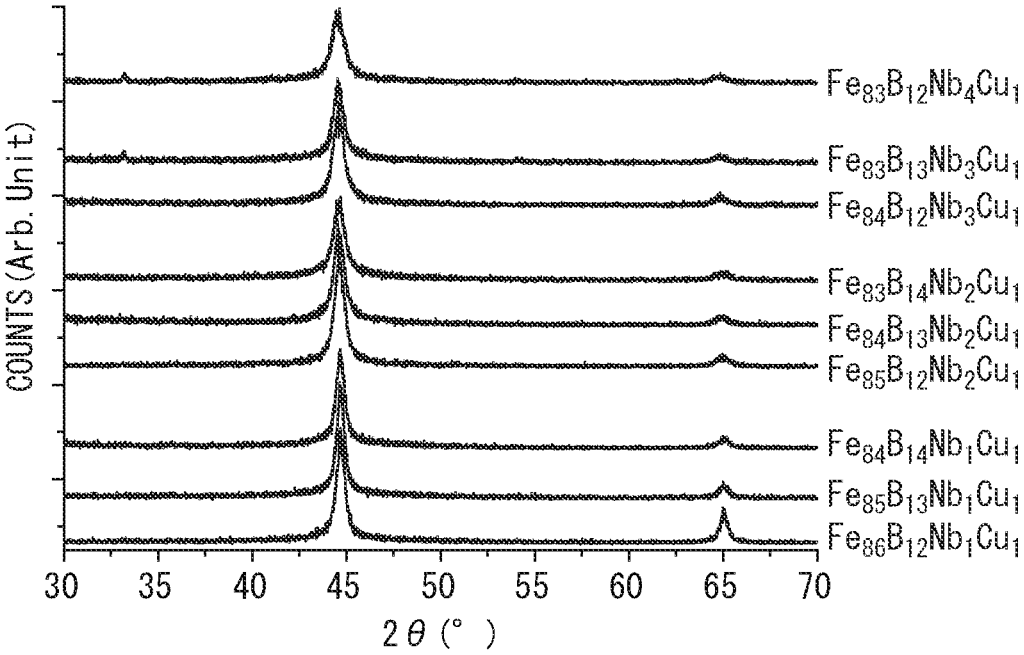
FIG. 10 is a graph showing the results of X-ray analysis of soft magnetic materials after having rapidly raised the temperature of amorphous alloys and held at that temperature for a short period of time (rate of temperature rise: 415° C./sec, holding temperature: varied between 485° C. and 570° C., holding time: 0 sec).

FIG. 10 is a graph showing the results of X-ray analysis of soft magnetic materials after having rapidly raised the temperature of amorphous alloys and held at that temperature for a short period of time (rate of temperature rise: 415° C./sec, holding temperature: varied 485 to 570° C., holding time: 0 to 30 sec).

As can be understood from FIG. 3, coercive force was able to be confirmed to decrease when a temperature of an amorphous alloy having the composition $Fe_{86}B_{13}Cu_1$ was rapidly raised in and held at that temperature for a short period of time.

As can be understood from FIG. 4, coercive force was able to be confirmed to increase if holding temperature exceeds the temperature at which Fe—B compounds start to form (517° C.) when a temperature of an amorphous alloy having the composition $Fe_{85}B_{13}Nb_1Cu_1$ was rapidly raised and held at that temperature for a short period of time.

As can be understood from FIG. 5, although coercive force increased gradually as a result of increasing holding time, coercive force was able to be confirmed to be maintained at 10 A/m or less if holding time is 80 seconds or less when a temperature of an amorphous alloy having the composition $Fe_{85}B_{13}Nb_1Cu_1$ was rapidly raised and held at that temperature for a short period of time.

As can be understood from FIG. 6, coercive force was able to be confirmed to decrease due to an increase in rate of temperature rise when a temperature of an amorphous alloy having the composition $Fe_{85}B_{13}Nb_1Cu_1$ was rapidly raised and held at that temperature for a short period of time.

As can be understood from FIG. 7, coercive force was able to be confirmed to decrease when a temperature of an amorphous alloy having the composition $Fe_{87}B_{13}$ was rapidly raised and held at that temperature for a short period of time. In addition, at a holding temperature of less than 400° C., the amorphous phase did not crystallize and desired saturation magnetization is thought to be unable to be obtained even if held at that temperature for 300 seconds.

As can be understood from FIG. 8, coercive force was able to be confirmed to increase if holding temperature exceeds the temperature at which Fe—B compounds start to form (488° C.) when a temperature of an amorphous alloy having the composition $Fe_{87}B_{13}$ was rapidly raised and held at that temperature for a short period of time.

As can be understood from FIG. 9, coercive force was able to be confirmed to decrease due to an increase in the rate of temperature rise when a temperature of an amorphous alloy having the composition $Fe_{85}B_{13}Nb_1Cu_1$ was rapidly raised and held at that temperature for a short period of time.

In addition, as can be understood from Table 1, when rapidly raised the temperature of an amorphous alloy and held at that temperature for a short period of time (Examples 1 to 65), low coercive force was able to be confirmed to be obtained while maintaining high saturation magnetization. On the other hand, when slowly raising the temperature of an amorphous alloy and holding at that temperature for a long period of time (Comparative Example 1), although high saturation magnetization was obtained, coercive force was able to be confirmed to increase.

Furthermore, the reason for the existence of examples in which coercive force does not increase despite the holding temperature being higher than the temperature at which Fe—B compounds start to form is thought to be as indicated below. The temperatures at which Fe—B compounds start to form indicated in Table 1 were measured by differential thermal analysis. The rate at which the temperature of samples is raised in differential thermal analysis is extremely slow. In general, the temperature at which a compound starts to form is affected by the rate at which temperature is raised. Thus, the temperature at which Fe—B compounds start to form as measured by differential thermal analysis is thought to be lower than the temperature at which Fe—B compounds start to form when the temperature of the amorphous alloy is raised rapidly. This is also supported by the finding that peaks corresponding to Fe—B compounds are not observed in X-ray diffraction analysis for the samples of all of the examples as shown in FIG. 10.

In addition, when average grain diameter is calculated from half width based on the X-ray diffraction chart of FIG. 10, the average grain diameter was able to be confirmed to be 30 nm or less.

The effects of the present invention were able to be confirmed on the basis of the above results.

REFERENCE SIGNS LIST

1 Amorphous alloy
2 Block
3 Temperature controller

The invention claimed is:

1. A method for producing a soft magnetic material, comprising:

preparing a Cu-free alloy having a composition represented by the following Compositional Formula 1 and having an amorphous phase, and heating the Cu-free alloy at a rate of temperature rise of 10° C./sec or more and holding for 0 to 80 seconds at a temperature equal to or higher than a crystallization starting temperature and lower than a temperature at which Fe—B compounds start to form, wherein the Compositional Formula 1 is $Fe_{100-x-y}B_xM_y$, M is at least one element selected from the group consisting of Mo, Ta, W, Ni, Co and Sn, and x and y are in atomic percent (at %) and satisfy the relational expressions of $10 \leq x \leq 16$ and $0 \leq y \leq 8$.

2. The method according to claim 1, wherein the Cu-free alloy is obtained by quenching a melt.

3. The method according to claim 1, wherein the rate of temperature rise is 125° C./sec or more.

4. The method according to claim 1, wherein the rate of temperature rise is 325° C./sec or more.

5. The method according to claim 1, wherein the Cu-free alloy is held for 0 seconds to 17 seconds at the temperature equal to or higher than the crystallization starting temperature and lower than the temperature at which Fe—B compounds start to form.

6. The method according to claim 1, comprising:

clamping the Cu-free alloy between heated blocks and heating the Cu-free alloy.

* * * * *